US007587869B2

(12) United States Patent
Lahni

(10) Patent No.: US 7,587,869 B2
(45) Date of Patent: Sep. 15, 2009

(54) PROFILE RAIL FOR A FACADE SYSTEM

(75) Inventor: Christian Lahni, Unna (DE)

(73) Assignee: RP Technik GmbH Profilsysteme (DE)

( * ) Notice: Subject to any disclaimer, the term of this patent is extended or adjusted under 35 U.S.C. 154(b) by 0 days.

(21) Appl. No.: 11/779,994

(22) Filed: Jul. 19, 2007

(65) Prior Publication Data

US 2008/0016797 A1 Jan. 24, 2008

(30) Foreign Application Priority Data

Jul. 19, 2006 (DE) ..... 10 2006 033 455

(51) Int. Cl.
*E06B 3/26* (2006.01)
*E04H 1/00* (2006.01)

(52) U.S. Cl. ..... 52/235; 52/202

(58) Field of Classification Search ..... 52/202, 52/235

See application file for complete search history.

(56) References Cited

U.S. PATENT DOCUMENTS 5,381,637 A * 1/1995 Farag ..... 52/204.595
2003/0033764 A1 * 2/2003 Ting ..... 52/235
2004/0079038 A1 * 4/2004 Crooker, Jr. ..... 52/235
2005/0188634 A1 * 9/2005 Bolton et al. ..... 52/235

FOREIGN PATENT DOCUMENTS

DE 20203053 * 6/2002

* cited by examiner

*Primary Examiner*—Richard E Chilcot, Jr.
*Assistant Examiner*—Andrew J Triggs
(74) *Attorney, Agent, or Firm*—Jack Schwartz & Associates, PLLC

(57) ABSTRACT

Profile rail for a facade system for the facing of a building, which can be secured in place on a substructure of the building for the fastening of filler elements, wherein the cross sectional profile of the profile rail formed of steel comprises a bolt groove section, cooperating directly with securement bolts, as well as at least one further holding section disposed next to the bolt groove section for sealing means, wherein in the region between the bolt groove section and the holding section adjoining hereon, window-like through-holes are provided, through which the underside of the bolt groove section is accessible for applying a welding seam between profile rail and substructure.

10 Claims, 4 Drawing Sheets

PROFILE RAIL FOR A FACADE SYSTEM

FIELD OF THE INVENTION

The invention relates to a profile rail for a facade system for the facing of a building, which can be applied on a substructure of the building, for securing in place filler elements, the cross sectional profile of the profile rail formed of steel comprising a bolt groove section cooperating directly with securing means as well as at least one further section, a holding section, for sealing means disposed next to the bolt groove section. The present invention relates, in addition, to a facade system comprising such a profile rail.

BACKGROUND OF THE INVENTION

DE 202 03 053 U1 discloses a facade system according to the genus. The facade system is constructionally adapted to a building substructure of uprights and/or bars disposed transversely thereto. Uprights and bars are here preferably produced of hollow profiles of steel. In the metal frame being set up are disposed filler elements, for example compound glass pane elements. The termination toward the outside is formed, for example, by a holding cleat which holds the filler elements with securement bolts cooperating with the metal frame. On the side of the substructure and on the side of the holding cleat are disposed inner and outer sealing elements, respectively, for sealing the facade system. To secure the holding cleat, furthermore, a separate profile rail is provided applied directly in contact on the substructure. The cross sectional profile of the profile rail includes a central bolt groove section, cooperating directly with securement bolts, as well as two further holding sections located next to the bolt groove section and fixing the inner sealing element.

The known profile rails are universally applicable and securable on a substructure of metal or other materials comprised, for example, of T-beams, rectangular profiles and the like. The facade system structured thus is consequently largely independent of the type of substructure and, to this extent, can be shaped flexibly. Since, in the sense of an integration of functions, the profile rail specifies the insertion sites for the securement bolts as well as also the fixing regions for the inner sealing elements, mounting errors as a consequence of nonobservance of mounting measures at the construction site are excluded. Since the securement bolts cooperate directly, thus without the use of additional means, with the bolt groove section, parts, otherwise customary, in the form of nuts or clamping elements are saved. The solution disclosed here, furthermore, prevents the problem of contact corrosion between substructure and profile rail. Contact corrosion may develop, for example, through moisture accumulating between substructure and profile rail. However, this problematic is prevented here in that the underside of the profile rail facing the substructure is provided with space-maintaining means which during the mounting of the profile rail come into contact with the substructure in order to form a rear-ventilated gap, continuous in the transverse direction with respect to the underside, between the profile rail and the substructure. Through the rear ventilation of the profile rail realized therewith waterlogging and corrosion caused thereby is effectively avoided.

To secure the profile rail in place on the substructure, elongated holes are provided in the region of the holding section of the profile rail facing the substructure. Through these elongated holes the profile rail can either be directly welded onto the substructure or, alternatively, the elongated holes can also be utilized to bolt them together.

However, in case of a welding connection, it is not possible to exclude under all circumstances the possibility that the welding seam wells out in the proximity of the elongated hole of the profile rail, which at this site causes the protrusion of the welding seam. This welding seam protrusion is problematic if the profile rail is to be covered at this site by a sealing element. For the welding seam protrusion prevents at least locally uniform contact of the sealing on the profile rail.

EP 0 692 586 A1 discloses an alternative solution for securing a profile rail on a substructure through welding, in which the welding seam extends beneath a bolt channel or reception channel profile only implemented substantially in the form of a U. At this site the welding seam course does not hinder the course of the adjacent sealing elements. However, since the reception channel profile to be welded on or its bolt channel is only U-shaped and the welding connection to the substructure is carried out in the immediate proximity between the substructure and the oblique surfaces of the bolt channel or receiving channel profile, the use of an additional welding device is by necessity required during the mounting at the construction site in order to position the bolt channel structure functionally correct with respect to the substructure. This technical solution, in comparison to the above discussed prior art, moreover, does not permit the integrated guidance of the adjacent sealing element.

SUMMARY OF THE INVENTION

The present invention therefore addresses the problem of providing a profile rail of the type of interest here with integrated sealing holding means, which can be secured to a substructure in conformance with the sealing pattern while observing the most extensive prevention of structural conditions for gap corrosion.

Building on a profile rail according to the preamble of claim 1, the problem is solved in connection with its characterizing features. The succeeding independent claims express advantageous further developments of the invention. In view of a facade system comprising the profile rail according to the invention, the problem is solved through claim 10.

The invention includes the technical teaching that in the case of the profile rail in the region between the central bolt groove section, which is preferably implemented in the shape of a U, and the holding section adjoining thereon, window-like through-holes are provided, through which the underside of the bolt groove section is accessible for applying a welding seam between profile rail and substructure.

The advantage of the solution according to the invention comprises in particular that, without having to employ special welding devices, with these through-holes suitable welding regions which do not hinder the sealing are made accessible, which are otherwise obscured through the profile rail formed of sheet steel. Due to the non-accessibility from the outside, the site between bolt groove section and substructure is normally not considered for the application of a welding seam. A person of skill in the art would limit himself to naturally accessible sites. The invented solution overcomes this mindset obvious to a person of skill in the art and through the additional window-like through-holes at the specifically defined sites provides the feasibility of applying a welding seam where its course—even in the presence of a protruding welding seam—does not disturb the course of a sealing covering the profile rail. The window-like through-holes can be generated in simple manner during the production of the profile rail by punching before the forming.

On both sides of the bolt groove section of the profile rail are preferably provided holding sections for sealing means, wherein in the proximity of the bolt groove section and the one holding section adjoining thereon as well as in the proximity of the bolt groove section and the other holding section, through-holes associated with each are placed. Hereby a welding seam can be alternately applied on both sides of the bolt groove section in order to maximize the hold. Through-holes are preferably disposed pairwise at the same level and oppositely on the profile rail, which permits overall application of corrosion protection onto the welding seam as well as onto the backside of the welding seam. This measure serves for further minimizing the corrosion proneness in the proximity of the welding seam.

The window-like through-holes of the profile rail are preferably implemented such that they extend in the manner of elongated holes in the longitudinal extent of the profile rail. This permits achieving an optimum of required space for applying the welding seam and loss of sturdiness due to the through-holes according to the invention, that must be accepted. Number and spacing of the through-holes required along the profile rail can be determined depending on the material thickness and geometric dimensions of the profile rail.

According to a further measure improving the invention it is proposed that in the region of the holding section facing the substructure are provided several deep-drawn sectors spaced apart from one another for the at least partial accommodation of the head of a securement means. These preferably elongated hole-like or round deep-drawn sectors extend over so large an area that thereby the direct securement is possible, such that the head of a securement means, such as a bolt or set bolt, does not project thereby hindering the course of the sealing. On the underside of the profile rail these deep-drawn sectors simultaneously form in connection with the substructure a rear-venting gap in order to prevent waterlogging and contact corrosion caused hereby. To this extent the deep-drawn sectors specified here fulfil a double function. The deep-drawn sectors can be produced in a single fabrication step, preferably jointly with the punching of the window-like through-holes.

A further feature improving the invention comprises that each holding section of the profile rail is preferably equipped with a margin region bent off at an angle and inclined in the direction toward the bolt channel section. The margin region bent off at an angle can also be produced in simple manner through forming—preferably roll-forming—and serves for the effective clamping and guiding of an inner sealing covering the profile rail. The invented profile rail provides the prerequisite for being able to use one and the same inner sealing for bars as well as also for uprights of the substructure, which leads to corresponding material savings and lowers the number of variants of the required sealings.

With the profile rail according to the invention a facade system can advantageously be shaped for the facing of a building on whose substructure the profile rail is secured, wherein between the profile rail and filler elements to be held hereby said inner sealing is provided and whereon on the opposite side of the, for example, filler elements, an outer sealing extends, which is supported, for example, by an outer holding cleat detachably applied with several securement bolts engaging directly into the bolt channel section of the profile rail. As securement bolts are suitable bolts which, in cooperation with the invented profile rail of steel, are self-threading bolts.

BRIEF DESCRIPTION OF THE DRAWINGS

Further measures improving the invention will be described in further detail in the following together with the description of a preferred embodiment example of the invention in conjunction with the Figures. Therein depict.

DETAILED DESCRIPTION OF THE DRAWINGS

Figure 1:
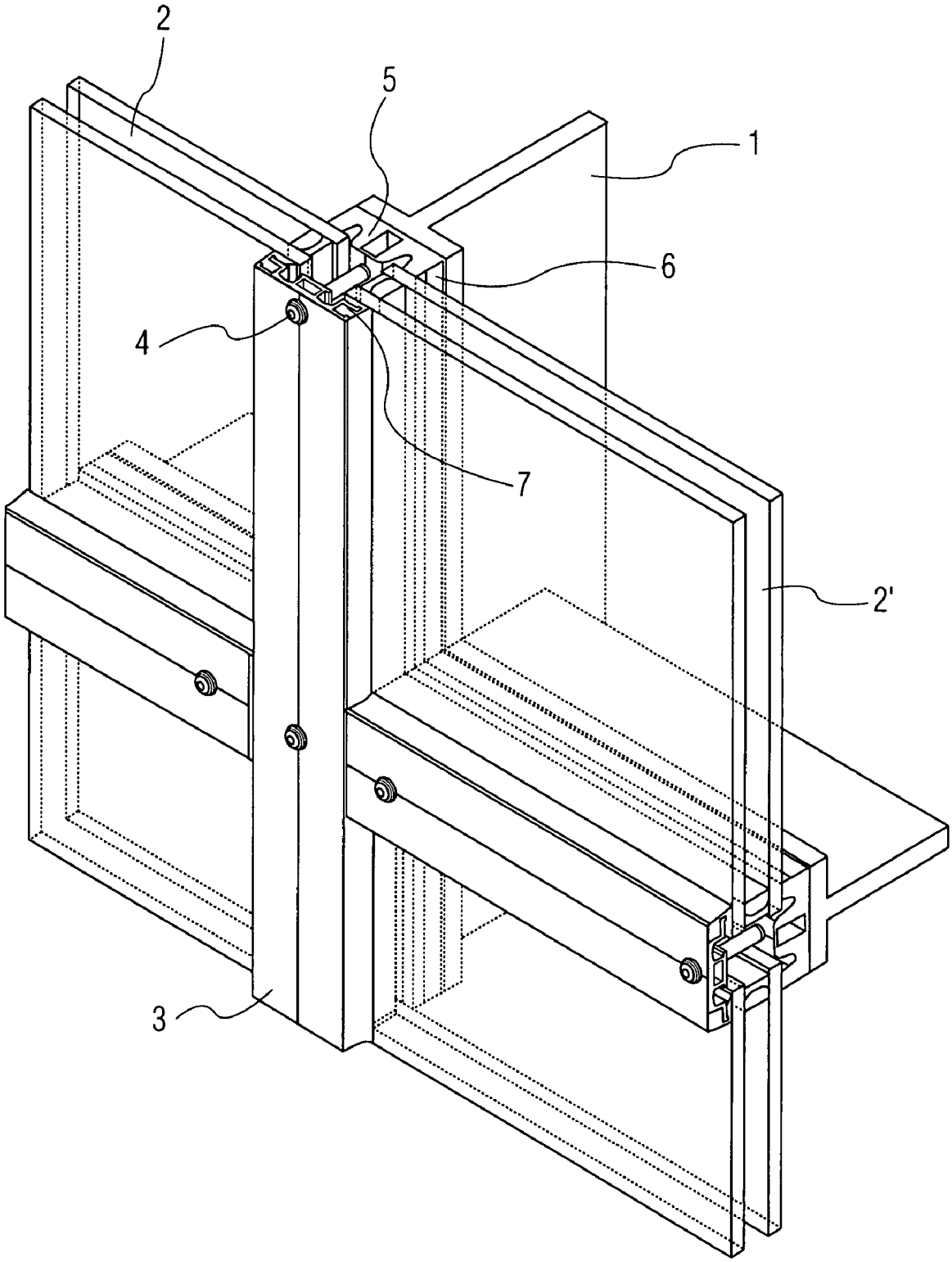
FIG. 1 a perspective illustration of a facade system in a view from the outside, FIG. 2 a perspective illustration of the profile rail used in FIG. 1 from above, FIG. 3 a perspective illustration of the profile rail in FIG. 1 from below, and FIG. 4 a cross section illustration of the profile rail.

The facade system according to FIG. 1 is mounted on a substructure 1 of steel composed of perpendicular uprights and bars extending transversely thereto. The substructure 1 is associated with the building and in this embodiment example is comprised of T-beams. The facade system serves for securing in place filler elements 2, 2', implemented as compound glass pane elements, which are provided for the facing of the building, not further shown. The filler elements 2, 2' are detachably connected with the substructure 1 via outer holding cleats 3 by means of securement bolts 4. For this purpose the securement bolts 4 come into engagement into an additional profile rail 5 applied stationarily on the substructure 1. Between the profile rail 5 and the filler elements 2, 2' to be held herewith, an inner sealing 6 is additionally provided. On the opposite side of the filler elements 2, 2' an outer sealing 7, supported by the outer holding cleat 3, extends analogously.

Figure 2:
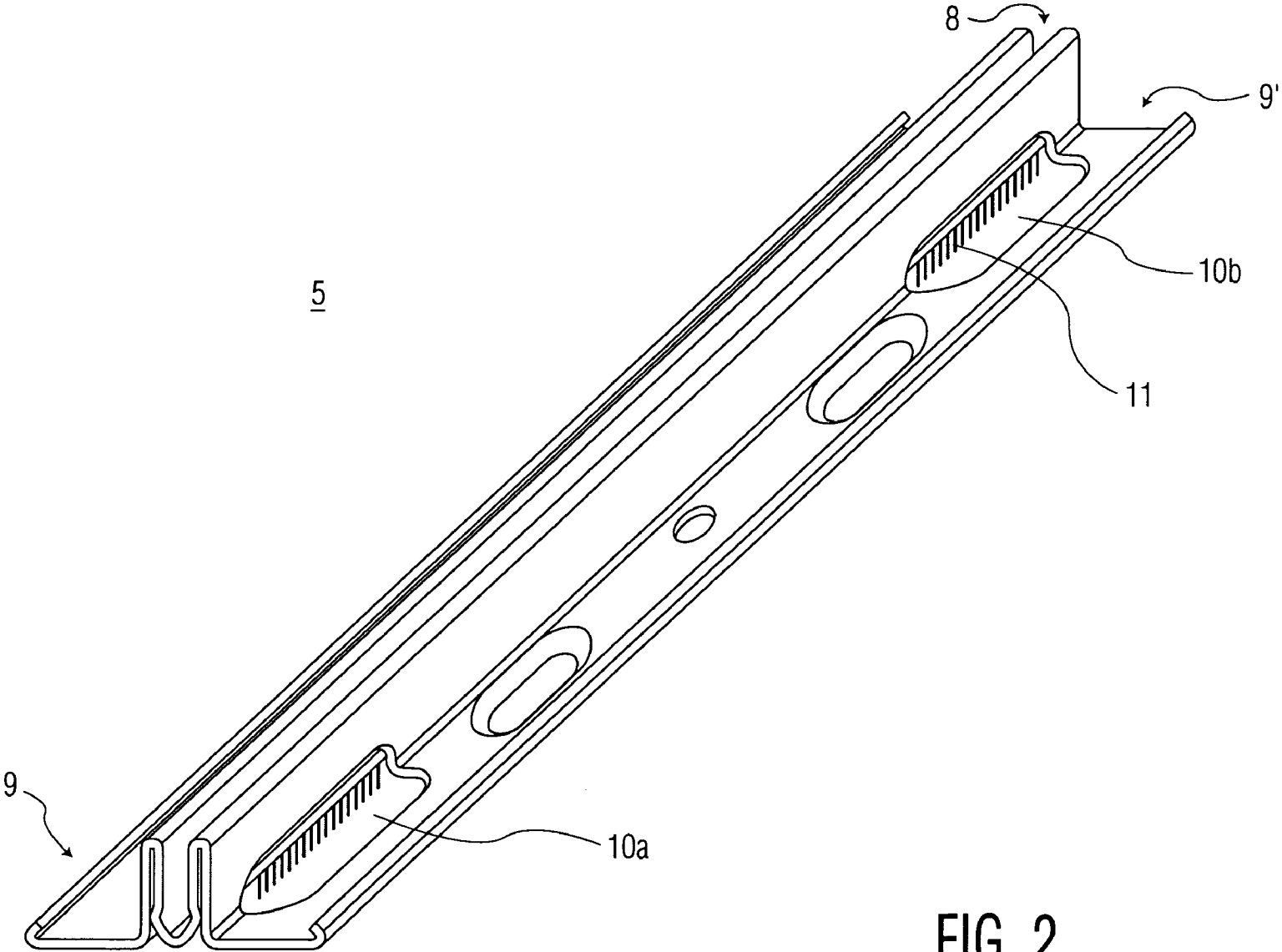

According to FIG. 2 the profile rail 5 comprised of steel is profiled through the forming in order to yield a central bolt groove section 8 cooperating directly with securement means—not further shown here—as well as two further holding sections 9, 9' disposed next to the bolt groove section 8 for sealing means, also not further shown.

In the region between the bolt groove section 8 and the holding section 9 or 9', respectively, adjoining thereon, window-like through-holes 10*a*, 10*b* are provided through which the underside of the bolt groove section 8 is accessible for the application of a welding seam 11 between profile rail 5 and substructure, not further shown here. The through-holes 10*a*, 10*b* are implemented such that they extend as elongated holes in the longitudinal extent of the profile rail 5 and are produced by punching.

Figure 3:
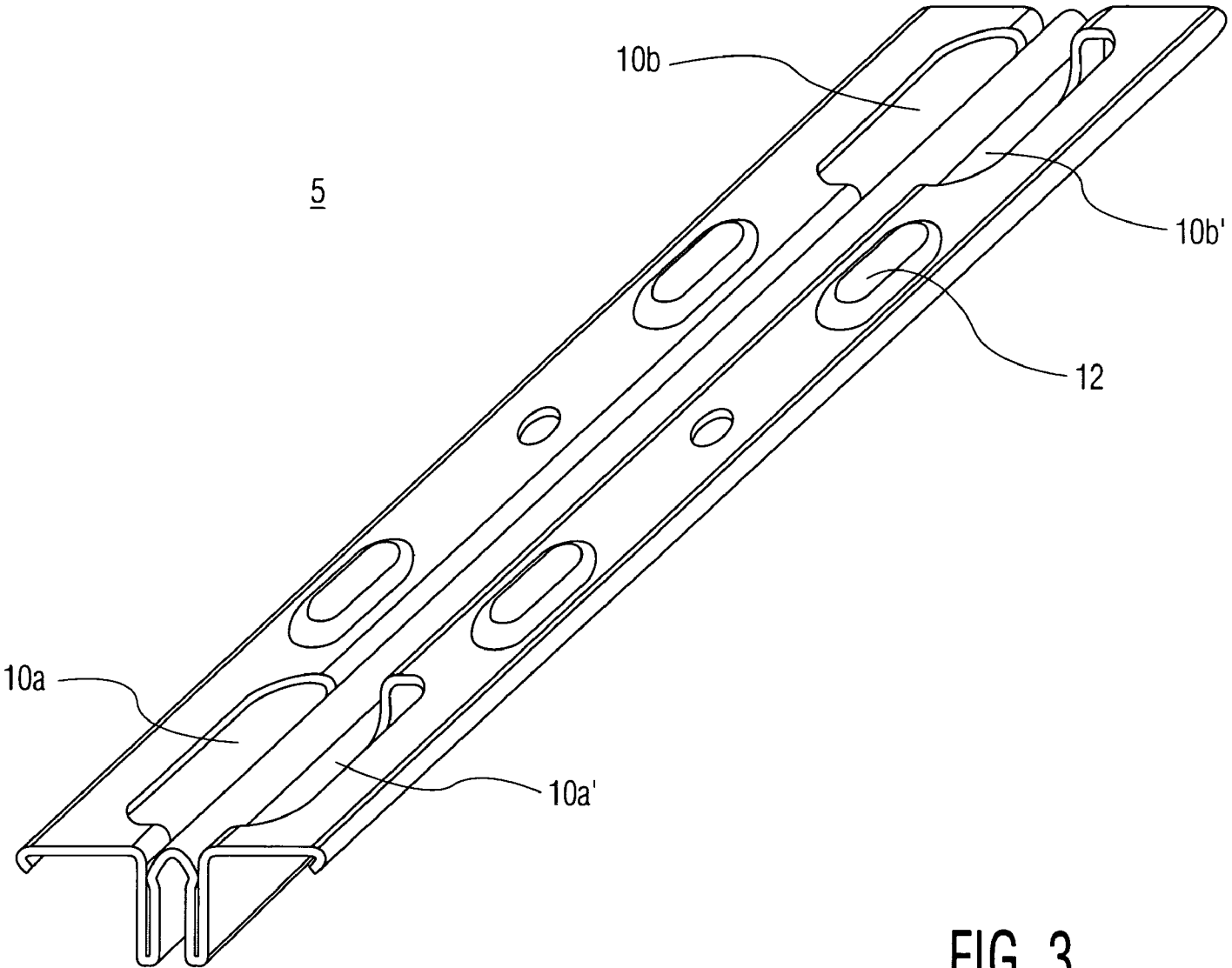

As FIG. 3 illustrates, the through-holes 10*a*, 10*a'* and 10*b*, 10*b'*, respectively, extend pairwise on the same level and opposite one another on profile rail 5. Hereby alternating welding to the substructure as well as also accessibility of the welding seam for corrosion protection measures are ensured.

At the site facing the substructure the profile rail 5 is, in addition, provided with several deep-drawn sectors 12 spaced apart from one another. The deep-drawn sectors 12 serve, on the one hand, for accommodating the head of a securement means (viewed from the opposite side) and form on the underside, visible here, of the profile rail 5, in cooperation with the substructure, a rear-venting gap for the prevention of moisture accumulations. All deep-drawn sectors 12 have an elongated hole-like contour, which, analogously to the through-holes 10*a*-10*b*, also extend in the longitudinal extent of the profile rail 5.

Figure 4:
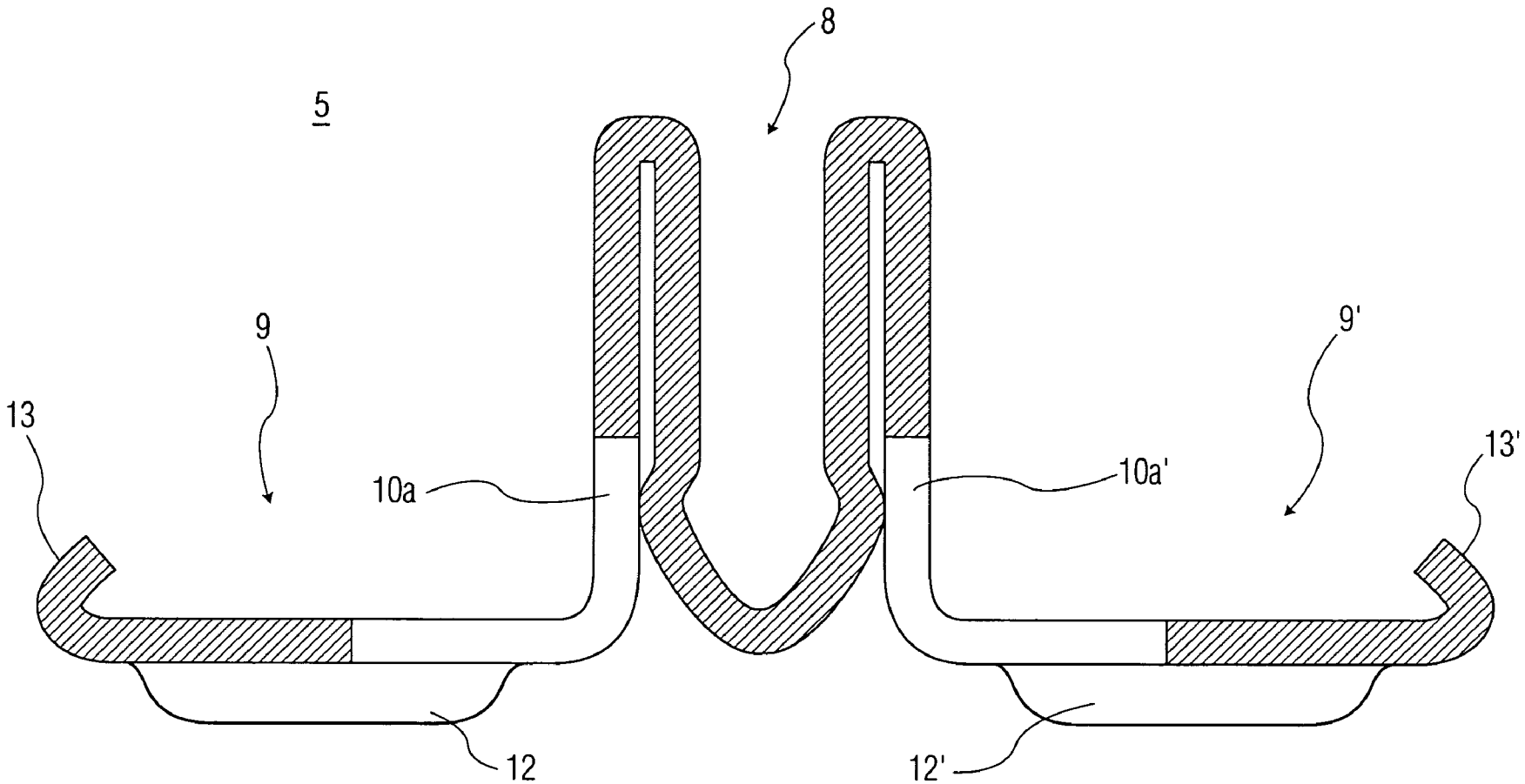

FIG. 4 illustrates in cross section the course of the deep-drawn sectors 12 as well as of the through-holes 10*a*, 10*a*' on profile rail 5. The two holding sections 9 and 9' of the profile rail 5 have furthermore a margin region 13 and 13', respectively, bent at an angle and inclined in the direction toward the bolt channel section 8 for clamping and guiding the inner sealing, not further shown here.

The invention is not limited to the above described preferred embodiment example. Rather, modifications hereof are also conceivable, which are encompassed by the protective scope of the succeeding claims. Thus, for example, it is also conceivable to realize an invented profile rail with only one holding section adjacent to the bolt groove section and hereinbetween dispose though-holes to provide access for welding means.

I claim:

1. Profile rail for a facade system for the facing of a building, which can be applied on a substructure of the building for securing in place filler elements, wherein the cross sectional profile of the profile rail formed of steel comprises a bolt groove section cooperating directly with securement bolts as well as at least one further holding section disposed next to the bolt groove section for sealing means, wherein in the region between the bolt groove section and the holding section adjoining hereon, window-like through-holes are provided, through which the underside of the bolt groove section is accessible for the application of a welding seam to the underside of the bolt groove section for welding the underside of the bolt groove section to the substructure.

2. Profile rail as claimed in claim 1, wherein on both sides of the bolt groove section holding sections are provided, wherein in each, the region of the bolt groove section and the one holding section adjoining hereon, as well as in the region of the bolt groove section and the other holding section adjoining hereon, are provided through-holes associated therewith.

3. Profile rail as claimed in claim 2, wherein the through-holes are disposed pairwise at the same level and opposite one another.

4. Profile rail as claimed in claim 1, wherein the through-holes are implemented as elongated holes extending in the longitudinal extent of the profile rail.

5. Profile rail as claimed in claim 1, wherein in the region of the holding section facing the substructure are provided several deep-drawn sectors disposed such that they are spaced apart from one another, for the at least partial accommodation of the head portion of a securement means.

6. Profile rail as claimed in claim 5, wherein the securement means is implemented in the manner of a set bolt for the nondetachable direct securement on the substructure.

7. Profile rail as claimed in claim 5, wherein the deep-drawn sectors are provided for the formation of a rear-ventilation gap against contact corrosion between the substructure and the profile rail.

8. Profile rail as claimed in claim 5, wherein the deep-drawn sectors have an elongated-hole or round contour and extend in the longitudinal extent of the profile rail.

9. Profile rail as claimed in claim 1, wherein each holding section comprises a margin region bent at an angle and inclined in the direction toward the bolt channel section for clamping and guiding an inner sealing.

10. Facade system for the facing of a building at whose substructure a profile rail as claimed in claim 1 is secured in place, wherein between the profile rail and filler elements to be held hereby an inner sealing is provided, and wherein on the opposite side of the filler elements extends an outer sealing, which is supported by an outer holding cleat detachably fastened with several securement bolts engaging into the bolt channel section of the profile rail.

* * * * *